US006029288A

United States Patent [19]

Ge et al.

[11] Patent Number: 6,029,288

[45] **Date of Patent: *Feb. 29, 2000**

[54] POWER FLUSH TANK WITH IMPROVED AIR INDUCER

[75] Inventors: Ming Ge, Farmington Hills, Mich.; Danny G. Orlowski, Jr., Holland, Ohio

[73] Assignee: Sloan Valve Company, Franklin Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/149,846

[22] Filed: Sep. 8, 1998

[51] Int. Cl.[7] ..... E03D 3/10

[52] U.S. Cl. ..... 4/354; 4/362; 137/846

[58] Field of Search ..... 4/354, 361, 362, 4/541.6; 137/846

[56] References Cited

U.S. PATENT DOCUMENTS

| | | | |
|---|---|---|---|
| 996,588 | 6/1911 | Kennedy | 137/846 |
| 2,292,373 | 8/1942 | Groeniger | 137/846 |
| 4,233,698 | 11/1980 | Martin | 4/354 |
| 5,046,201 | 9/1991 | Steinhardt et al. | 4/354 |
| 5,142,714 | 9/1992 | Klotzbach | 4/541.6 |
| 5,361,426 | 11/1994 | Martin | 4/354 |
| 5,474,099 | 12/1995 | Boehmer et al. | 137/846 |

*Primary Examiner*—Charles R. Eloshway

*Attorney, Agent, or Firm*—Dorn, McEachran, Jambor & Keating

[57] ABSTRACT

A pressure flushing system for use in a toilet tank includes a housing with a water inlet conduit, an air and water inlet assembly connected to the conduit and to the housing, and a water outlet for the housing. There is a flush valve within the housing for controlling flow of water from the inlet to the housing outlet. The air and water inlet assembly includes a chamber, with a water inlet connected to the chamber, and an outlet connected to the chamber. There is an air inlet accessible to air at atmospheric pressure and a passage between the air inlet and the chamber. A check valve is located in the passage, with the check valve opening in response to a venturi effect caused by water flow through the chamber to draw air into the chamber to mix with water flowing through the chamber and to the outlet. The check valve includes an elastomeric sleeve positioned within the passage and having normally closed flexible lips extending toward the chamber. The lips open to permit the passage of air into the chamber to mix with the water therein when there is a pressure in the chamber less than atmospheric.

1 Claim, 1 Drawing Sheet

POWER FLUSH TANK WITH IMPROVED AIR INDUCER

THE FIELD OF THE INVENTION

The present invention relates to pressure flushing systems such as shown in U.S. Pat. No. 4,233,698 assigned to the assignee of the present application, Sloan Valve Company of Franklin Park, Ill. More specifically, the invention relates to the air inducer assembly which draws air into the flushing system pressure tank to provide the pressure for discharging the water therein. The air inducer assembly connects to the inlet water conduit and to air at atmospheric pressure, in a manner that the flow of water from a conventional water supply will draw air into the tank to pressurize the tank. The invention is most particularly directed to a specific type of check valve forming a part of the air inducer assembly, which check valve reduces the noise level of water and air flow into the tank and is effective to preclude the flow of moisture out of the air inlet, thereby eliminating water seepage into the toilet tank.

SUMMARY OF THE INVENTION

The present invention relates to pressure flushing systems for use in toilet tanks and more particularly to an improved check valve for use in the air inducer assembly of such a pressure flushing system.

A primary purpose of the invention is an improved check valve for the air inducer of a pressure flushing system, which check valve eliminates water seeping into the toilet tank and reduces airdraw noise.

Another purpose is a check valve for the use described which allows free flow with positive pressure differential, but provides backcheck at negative pressure differentials.

Another purpose is a simply constructed reliable check valve for the use described which resists corrosion and wear, and which is self-cleaning and easy to assemble.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Pressure flushing systems such as shown in U.S. Pat. No. 4,233,698, which is hereby incorporated by reference, use a pressure tank which is normally positioned within the tank of a gravity style toilet. Water at line pressure flows into the pressure tank and the flow of such water draws air into the pressure tank, with the end result that water within the tank is at line pressure, which may be anywhere from 20 to 80 psi. In some applications a pressure regulator is provided which maximizes the pressure within the tank to 35 psi. The advantage of such a system is that when the toilet is flushed and the flush valve within the pressure tank is operated, the water is forced from the pressure tank discharge into the toilet bowl for rapid and complete flushing of its contents.

Such pressure flushing systems have been on the market for a number of years. The present invention is more specifically directed to the air inducer which draws air into the pressure tank as water flows from the water supply into the pressure tank.

Figure 1:
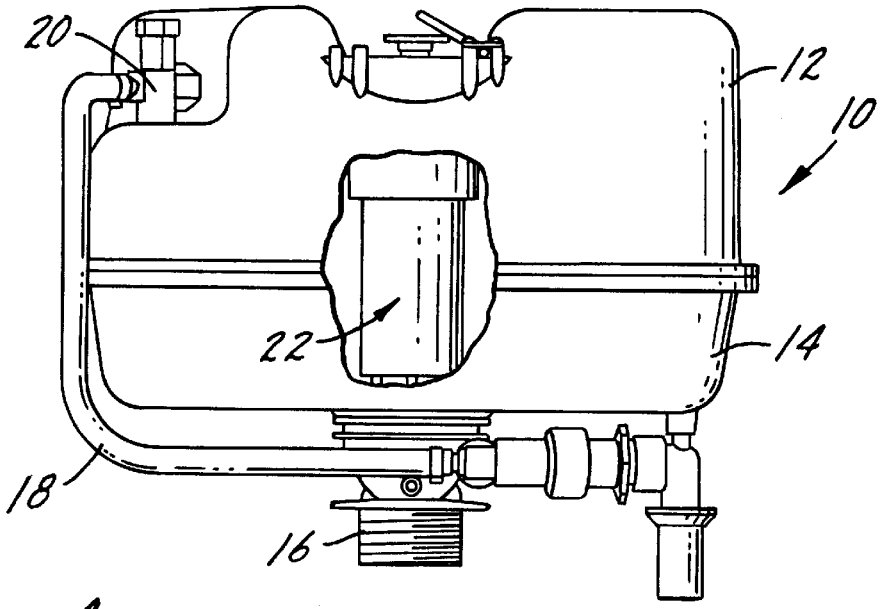
FIG. 1 is a side view of a pressure flushing system, with portions broken away to show the interior flush valve.
Figure 2:
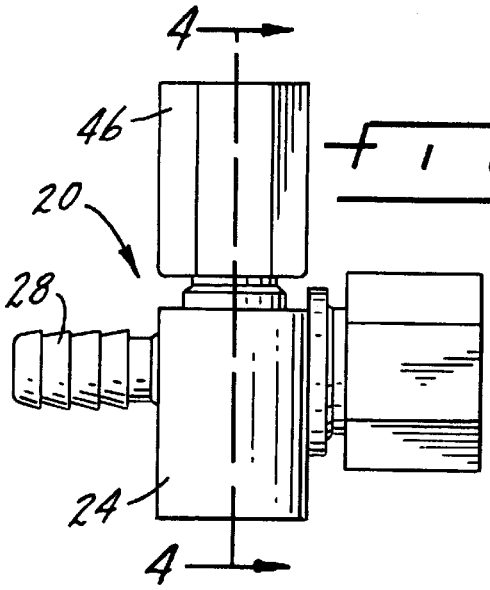
FIG. 2 is an enlarged side view of the air inducer assembly.
Figure 4:
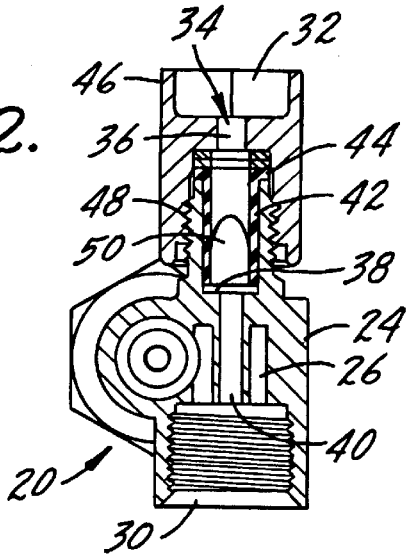
FIG. 4 is a section along plane 4—4 of FIG. 2.
Figure 3:
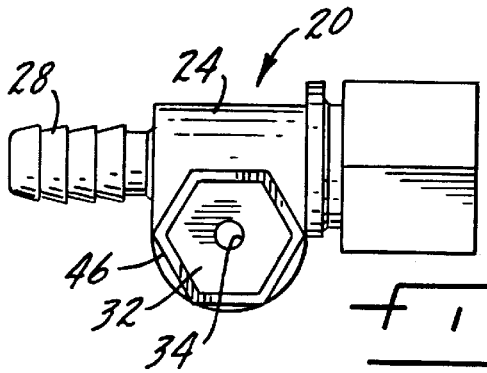
FIG. 3 is a top view of the air inducer assembly.

In FIG. 1, the pressure tank is indicated at 10 and may have a top section 12 and a bottom section 14, both of which may be made from a suitable plastic. There is an outlet 16 from the bottom of the tank and this outlet will conventionally be connected to a toilet bowl.

A water inlet conduit is indicated at 18 and will provide water at line pressure to a water and air inlet assembly 20 which is connected to the tank interior. A flush valve is indicated generally at 22 and when the flush valve is operated, normally by manual operation of the toilet, the water within the tank 10 will be discharged through the outlet 16. Further and more complete details of the pressure flushing system are disclosed in the '698 patent.

The present invention is more specifically concerned with the water and air assembly 20 and the manner in which it provides air to be drawn into the tank and the seal for such assembly to prevent water from seeping into the area outside of the tank 10, but within the surrounding toilet tank.

The assembly 20 includes a housing 24 within which is formed an annular chamber 26. There is a water inlet indicated at 28 which is in communication with the annular chamber 26. An outlet is indicated at 30, with the outlet discharging water and air into the confines of the tank 10. An air inlet is indicated at 32 and is in communication with a passage 34. The passage 34 has a first portion 36 adjacent the inlet 32, an intermediate portion of larger diameter indicated at 38, and then a termination portion 40 which is coaxial with the annular chamber 26 and opens into the outlet 30.

Located within the intermediate portion 38 of the passage 34 is a check valve 42 which is made of a flexible elastomeric or rubberlike material and has an outwardly extending flange 44 which is used to mount the check valve 42 between a fitting 46 forming the air inlet and an exteriorly threaded portion 48 of the housing 24. The check valve 42 has a pair of normally closed flexible tapered lips 50 which face the chamber 26 and which will be open as described hereinafter to allow air to flow toward the outlet 30.

The check valve 42 is commonly referred to as a duckbill because of the tapered normally closed sealing lips 50. When the tank 10 is being filled by water from the supply to the conduit 18, water will flow from the inlet 28 into the annular chamber 26. The flow of water into this chamber and toward the outlet 30 will create a venturi effect relative to the termination portion 40 of passage 34. Thus, the area directly adjacent the termination of passage portion 40 will be at a pressure less than atmospheric, whereas, the air outside of the tank 10 and at the air inlet 32 will be at atmospheric pressure. This positive pressure differential will cause air to flow through the check valve 42 with the duckbills or lips 50 opening to permit the passage of such air. Thus, the water flowing out of outlet 30 has air entrained therein, as such air is drawn by the venturi effect caused by the relationship of the chamber 26 and the termination portion 40 of the passage 34.

When the tank has been filled to a desired level such that the compressed air within the tank resists the flow of any further water therein, water will no longer flow into the chamber 26 and the flexible lips 50 will close. This will seal the air inlet preventing any seepage of water outwardly through it and into the area surrounding the tank 10, but within the toilet tank.

The particular type of check valve seal shown and described herein is advantageous, as it prevents the weeping or seepage of water into the toilet tank, allowing the tank to remain in a desirable dry condition. Further, this particular type of check valve has been shown to very substantially reduce the airdraw noise normally associated with the filling of a pressure flushing system such as described herein. The check valve is self-cleaning in that dust or particles lodged in the valve will be forced through the valve by the passage of air. Also, because the valve is made of an elastomeric material, it will not corrode.

Whereas the preferred form of the invention has been shown and described herein, it should be realized that there may be many modifications, substitutions and alterations thereto.

The embodiments of the invention in which an exclusive property or privilege is claimed are defined as follows:

1. A pressure flushing system for use in a toilet tank including a housing, a water inlet conduit, an air and water inlet assembly connected to said conduit and to said housing, a water outlet for said housing, flush valve means within said housing for controlling the flow of water from said housing to said outlet, said air and water inlet assembly including a body, an annular chamber within said body, a water inlet in said body and opening to said annular chamber, said inlet being connected to said conduit to supply water to said chamber, an outlet connected to and coaxial with said chamber, said body having a threaded extension and a fitting mounted thereon, said fitting including an air inlet accessible to air at atmospheric pressure, a passage in said assembly between said air inlet and said outlet, said passage including a first portion in said fitting and opening to said air inlet, an intermediate portion in said body extension, a termination portion integrally formed in said body as a cylindrical inner extension thereof, spaced inwardly from said annular chamber along substantially the entire length of said termination portion and opening to said annular chamber, said termination passage portion being coaxially within and parallel to said annular chamber and having a coextensive termination therewith, a check valve in said intermediate passage portion and having a mounting portion fixed in position between said fitting and said body extension, said check valve opening in response to a venturi effect caused by water flow through said chamber to draw air into said chamber to mix with water flowing through said chamber to said outlet, said check valve including an elastomeric sleeve positioned within said intermediate passage portion and having normally closed flexible lips extending toward said chamber, said lips opening to permit the passage of air into said chamber when there is a pressure in said chamber less than atmospheric.

* * * * *